US007780540B2

(12) United States Patent
Zhou

(10) Patent No.: US 7,780,540 B2
(45) Date of Patent: Aug. 24, 2010

(54) GOLF SWING PRACTICE TARGET PANEL AND METHOD OF USING

(76) Inventor: Ke Zhou, 3500 Barrett Dr., Apt. 5K, Kendall Park, NJ (US) 08824

( * ) Notice: Subject to any disclaimer, the term of this patent is extended or adjusted under 35 U.S.C. 154(b) by 0 days.

(21) Appl. No.: 12/118,065

(22) Filed: May 9, 2008

(65) Prior Publication Data

US 2009/0280922 A1 Nov. 12, 2009

(51) Int. Cl.
*A63B 69/36* (2006.01)

(52) U.S. Cl. ..... 473/190; 473/172

(58) Field of Classification Search ..... 473/150–197
See application file for complete search history.

(56) References Cited

U.S. PATENT DOCUMENTS

| | | | | | |
|---|---|---|---|---|---|
| 1,485,089 | A * | 2/1924 | Musselman | 473/193 |
| 1,703,672 | A * | 2/1929 | Housden | 473/190 |
| 1,719,240 | A * | 7/1929 | Scanlan | 473/190 |
| 2,234,814 | A * | 3/1941 | Weaver | 473/190 |
| 3,128,627 | A * | 4/1964 | Harris | 473/164 |
| 3,643,959 | A * | 2/1972 | Cornell et al. | 473/152 |
| D261,791 | S * | 11/1981 | Todd | D21/790 |
| 5,020,802 | A * | 6/1991 | af Strom | 473/156 |
| 5,370,386 | A | 12/1994 | Parks | 273/26 |
| 5,516,115 | A | 5/1996 | McLain | 273/401 |
| 5,524,901 | A | 6/1996 | Bison | 273/400 |
| 5,549,302 | A * | 8/1996 | Lapsker et al. | 473/416 |
| 6,247,699 | B1 | 6/2001 | Macaluso | 273/400 |
| 6,761,644 | B1 | 7/2004 | Aubert | 473/197 |
| 6,769,993 | B1 * | 8/2004 | Lasalandra | 473/193 |
| 6,878,078 | B2 | 4/2005 | Swanson | 473/454 |
| 2007/0238540 | A1 * | 10/2007 | Lin | 473/172 |

* cited by examiner

*Primary Examiner*—Mark S Graham
(74) *Attorney, Agent, or Firm*—Walter J. Tencza, Jr.

(57) ABSTRACT

A golf swing practice target panel or impact device is provided. The impact device may be or may include a panel made of a type of material such that there will be a temporary mark where a standard or non-standard golf ball impacted the panel. An aiming reference point may be provided on a lower portion of the panel. In addition, lines may be printed on the panel to depict launch or elevation angles and off-center deviation angles. A golfer can examine how accurate the strike was after the swing. Also, the panel material may possess proper friction that enables the spinning direction of a golf ball to be determined when a golf ball bounces off from the panel. Judging from where the ball landed relative to the temporary ball mark on the panel, the golfer is able to know how the ball was spinning after striking.

11 Claims, 6 Drawing Sheets

GOLF SWING PRACTICE TARGET PANEL AND METHOD OF USING

FIELD OF THE INVENTION

This invention relates to improved methods and apparatus concerning golf training equipment.

BACKGROUND OF THE INVENTION

In the sport of golf, it is desirable to repeatedly practice swinging a golf club and striking a golf ball. It is important to achieve consistent golf ball flight patterns. A golfer can watch the flight of his golf ball, after striking it, to see if he or she is hitting the golf ball correctly.

Typically a golfer will go to a driving range to hit golf standard golf balls and to watch the flight patterns of those golf balls after hitting them. However, not every golfer can conveniently have access to driving ranges. In addition, it is expensive to practice often at a driving range.

Some golfers practice their golf swing in their backyard using non-standard golf balls, which fly shortened distances compared to standard golf balls. However, this method of practicing a golf swing still requires a large area, such as a large backyard. An alternative way for practicing a golf swing is to hit a standard or non standard golf ball into a conventional cage or net or other blocking/protecting material. However, it is difficult to follow the flight of the ball using this technique. These cage or net techniques typically do not provide accurate feedback about the practice swing.

There are some commercially available electronics apparatus that can provide golf ball flight parameter measurements. Most of these devices are based on radar for the measurements. These devices are often very expensive and complicated.

U.S. Pat. No. 6,761,644 B1 to Aubert discloses a portable target 10 for sporting projectiles. (Aubert, col. 4, Ins. 29-30). The target 10 includes a horizontal metal shelf 28 and a vertical wall 32, which is perpendicular to the shelf 28. (Aubert, col. 4, Ins. 60-63). The wall 32 is made of a mesh material. (Aubert, col. 4, Ins. 59-60). There is no indication that a golf ball impacting the mesh material would make an impression or leave any noticeable mark. The wall 32 is a blank wall without any image. An individual would hit golf balls towards the wall 32 and they would land on the shelf 28 between partitions. (Aubert, col. 6, Ins. 3-10).

U.S. Pat. No. 5,370,386 to Parks discloses a sports training target 10 including a plurality of shutters. (Parks, col. 4, Ins. 58-64). The target elements 50 of the shutters can be hit by a high speed projectile 54, such as a baseball or hockey puck. (Parks, col. 8, Ins. 9-18). The target elements 50 take a hit from a projectile 54, and rotate to allow the projectile 54 to pass through an opening 52, and thereafter target elements 50 return to their original position. (Parks, col. 8, Ins. 14-19). The shutter or target elements 50 are made of a material, which sustains little or no damage when struck repeatedly by sports projectiles. (Parks, col. 7, Ins. 1-11). Visual images or markers can be placed on the shutter or target elements 50. (Parks, col. 9, Ins. 39-41).

U.S. Pat. No. 5,516,115 to McLain discloses a practice target device for thrown, hit, or kicked balls. The target includes a netting 22 and a pocket 24, which may be the same material as the netting 22. (Mclain, col. 3, Ins. 3-15).

U.S. Pat. No. 6,247,699 to Macaluso discloses a foldable net 10. (Macaluso, col. 2, Ins. 43-45). The net 10 has a fabric section 42 which is arranged to absorb the impact of a projectile such as a golf ball, tennis ball, baseball, football and the like. (Macaluso, col. 3, Ins. 8-15).

U.S. Pat. No. 5,524,901 to Bison et al. discloses a sport target apparatus 100. (Bison, col. 2, In. 65—col. 3, In. 4). The apparatus 100 includes a target area 120, which includes a solid patch of material. (Bison, col. 3, Ins. 30-37). Target area 120 may be a natural or synthetic material, or vinyl or plastic sheet. (Id.) The target apparatus 100 can be used as a driving target for golf. (Bison, col. 6, Ins. 38-59).

U.S. Pat. No. 6,878,078 to Swanson discloses a baseball pitching target 20. (Swanson, col. 5, Ins. 30-35). When a first baseball 19 impacts the target 20, it creates a first visible indentation 18 of the target layer 27. (Swanson, col. 5, Ins. 57-67). When a second baseball impacts the target 20, it creates a second visible indentation or the target layer 27 and also smooths out the first visible indentation 18. (Id.) Visual indicia 21, 22, and 23 on the target 20 define different areas of a strike zone. (Swanson, col. 6, Ins. 3-15).

SUMMARY OF THE INVENTION

An object of at least one or more embodiments of the present invention is to provide a golf swing practice target panel that will enable golfers to practice their swing in a confined area with accurate post-impact feedback from a target panel or impact device about a golf ball striking launch or elevation angle, lateral accuracy or offset angle, and ball spinning direction. The target panel or impact device is designed for a golfer to practice a swing of a golf club hitting a standard or a non-standard golf ball.

A related object of one or more embodiments of the present invention is to provide a golf club swing practice target panel or impact device with a size about six feet in height and four feet in width, which will cover launch or elevation angles up to forty degrees and lateral off-center deviation angles up to twelve radius degrees (offset to either the left or the right), which are calculated based on a tee-off point seven feet away.

A related object of one or more embodiments of the present invention is to provide a golf swing practice target panel or impact device with printed lines on it to illustrate launch or elevation angles and off-center deviation angles, which are calculated based on a pre-set distance, such as seven feet, between the panel, or impact device and a point, mark or marker where the ball his hit with a golf club. In the middle of a lower portion of the panel or impact device, there may be an aiming reference point printed as well. The aiming reference point may be a large circle, or a quarter coin sized dot or an image of a golf ball.

Another related object of the invention is to provide a golf swing practice target panel or impact device made of a resilient velvet kind of fabric with thick, furry, soft pile on one or both surfaces. The backing of the fabric may be a weaved mesh with small space between threads. The furry pile on the surface will typically be pressed down where a ball strikes or impacts it and remain down after the ball bounces off the panel or impact device. The impact of the ball striking the fabric of the impact device or panel, will force air to go through the extra space between the threads, thus bring the pile in the approximate area substantially into its standing up position. This texture difference will present a temporary visually identifiable ball mark of the striking of the golf ball. This temporary ball mark or impression can be used to read the ball launch or elevation angle and lateral or offset accuracy judging from where the impression is located on the panel or impact device. The ball marks or impressions on the impact device or panel, can be erased by slightly touching the panel or impact device or gradually by the impact of new hits in the proximate area. The extra space between the threads will also reduce the popping sound of impact while letting air through when the ball strikes the panel.

Another related object of one or more embodiments of the present invention is to provide a golf swing practice target panel or impact device, which possesses a proper friction property that enables the spinning direction of the ball to be determined when the ball bounces off from the panel. Judging from where the ball lands relative to the ball mark or impression that the ball made on the panel, the golfer will be able to understand how the ball was spinning after striking.

Another related object of one or more embodiments of the present invention is to provide multiple versions of golf swing practice target panels or impact devices made of micro-fiber or materials with furry velvet surfaces, which are able to sustain different golf ball impacts. This is due to the weight difference of standard or non-standard (such as foam ball) golf balls.

A contributory object of one or more embodiments of the present invention is to provide a target panel or impact device with a colorful golf course scene printed on it, which gives the golfer a more realistic feeling as if playing on a real golf course.

Another contributory object of one or more embodiments of the invention is to sew rigid fabric tubes on top and bottom sides of the panel or impact device so that the fabric can be fastened on a designated frame. Velcro strips can also be used to fasten the target panel or impact device to an existing backing structure, such as a practice cage with net backings.

A target panel or impact device or one or more embodiments of the present invention will enable a golfer, when practicing their swing, to examine the launch or elevation angle, lateral accuracy (off-center deviation) and the spinning direction of the stroked ball after the swing. During the action of a golf swing, the golfer's eyesight is supposed to be on the ball prior to it being stroked by the club. With the post-impact ball marks or impressions on the panel or impact device, the golfer can exam the swing result after the swing. This accurate feedback from the panel or impact device enables the golfer to practice their swing in a confined area, such as indoor or in a backyard, and to still have good understanding about how the ball flies.

This invention may be used for other sport projectile practice. It is to be understood that the phraseology and terminology used herein are for the purpose of descriptions and should not be considered as limiting.

In at least one embodiment of the present invention an apparatus for use as a target for a sports projectile is provided. The apparatus may include a panel or impact device and a support structure for supporting the panel in an upright position. A substantially central vertical line may be located on the panel so that it can be seen by a user. A plurality of spaced apart substantially vertical offset lines may be located on the panel so that they can be seen by a user. Each of the plurality of spaced apart substantially vertical offset lines may be labeled to indicate an offset in relation to the substantially central vertical line. Each offset for each of the plurality of spaced apart substantially vertical offset lines may be an angular offset.

Each angular offset may be an angle between a first line and a vertical center plane. Each first line may be defined by a first end point at a marker or tee-off point and a second end point on one of the plurality of spaced apart substantially vertical offset lines. The vertical center plane or substantially vertical center plane may be defined by the substantially central vertical center line and the marker or tee-off point. Each of the plurality of spaced apart substantially vertical offset lines may represent a particular offset angle at different location on the panel. The angular offset may be directly related to percentage offset. For example, a three radius degrees offset may be about a 5.24% offset.

Each of the plurality of spaced apart substantially vertical offset lines may be labeled with a number to indicate a number of degrees. The marker may be located about seven feet from a point centrally located near or at the bottom of panel. The apparatus may include a golf mat. The marker may be a visual indication located on the golf mat. An image of a golf course scene may be located on the panel and the substantially central vertical line and the plurality of spaced apart substantially vertical offset lines may be located on the golf course scene.

A plurality of spaced apart substantially horizontal elevation lines may be located on the panel so that they can be seen by a user. Each of the plurality of spaced apart substantially horizontal elevation lines may be labeled to indicate an elevation in relation to a base elevation. Each elevation for each of the plurality of spaced apart substantially horizontal elevation lines may be an angular elevation.

Each angular elevation may be an angle made between a first line and a second line for each of the plurality of spaced apart horizontal elevation lines. For the angular elevations, the first line may be a line from a marker to a base location. Each second line may be a line from the marker to each of the plurality of spaced apart substantially horizontal elevation lines. Each of the plurality of spaced apart substantially horizontal elevation lines represents a particular elevation angle and may be labeled with a number to indicate a number of degrees.

The panel may include a material of a type such that when a golf ball impacts the material after the golf ball has been struck by a golf club, a visual indication is made on the panel indicating a location where the golf ball impacted the material. The visual indication may remain on the panel until removed by an external force.

The panel may be comprised of a material of a type that possesses proper frictional property so that when a golf ball impacts the material after the golf ball has been struck by a golf club, the panel will cause the golf ball to bounce back in a direction opposite of the spinning direction of the ball.

One or more embodiments of the present invention also include a method of using a golf target comprising placing a golf ball at a tee off location on a golf mat, and swinging a golf club and thereby striking the golf ball with a club head of the golf club and thus causing the golf ball to fly up from the golf mat and thereafter impact the golf target. The golf target may be a target as previously described.

DETAILED DESCRIPTION OF THE DRAWINGS

Figure 1:
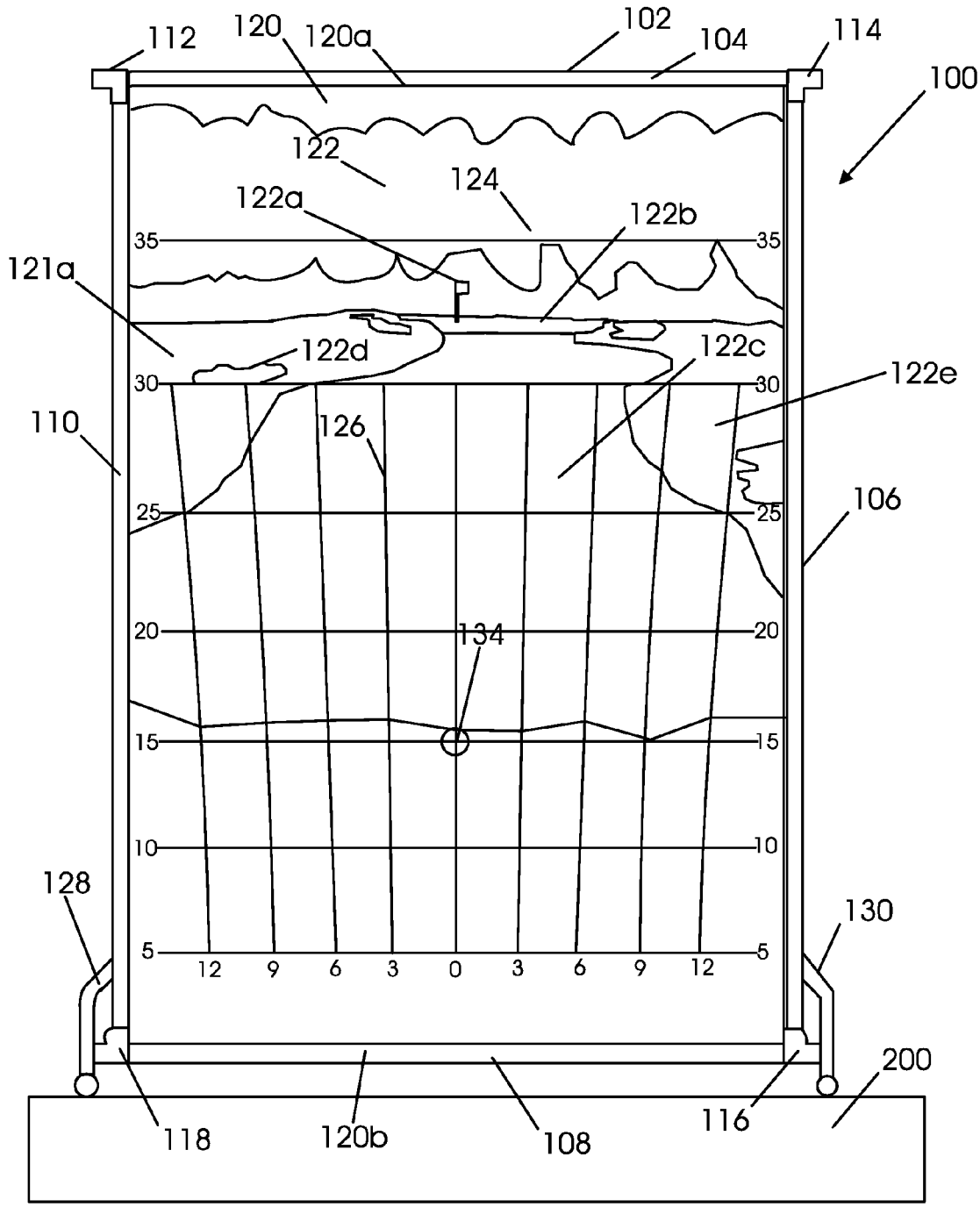
FIG. 1 shows a front view of an apparatus for use with an embodiment of the present invention.

FIG. 1 shows a front view of an apparatus 100 for use with an embodiment of the present invention. The apparatus 100 rests on a ground surface 200. The apparatus includes a mounting device 102, an impact device 120, and supports 128 and 130.

The mounting device 102 may include members 104, 106, 108, and 110. The members 104, 106, 108, and 110 may be elongated rigid members, such as rigid plastic, metal or wood members or pipes. The members 104 and 106 are connected by connecting device 114, the members 106 and 108 are connected by connecting device 116, the members 108 and 110 are connected by connecting device 118, and the members 110 and 102 are connected by connecting device 118.

The impact device or target panel 120 may be a cloth, such as a fabric made of one hundred percent polyester. The impact device 120 may include a print or image 122 of a golf course hole from the perspective of a person on a tee of the golf course hole. The print or image 122 includes an image of a golf course hole flag 122*a*, a golf course hole green 122*b*, a golf course hold fairway 122*c*, a golf course hole hazard 122*d* (such as a sand trap or lake), and a golf course hole rough 122*e*.

The impact device or target panel 120 may have a front surface 121*a* shown in FIG. 1. A ball, such as a golf ball would typically be hit into the front surface 121*a*. The front surface 121*a* may be comprised of a resilient velvet or a fabric with furry, thick and soft pile. The front surface 121*a* may include a plurality of hair, extensions, or strands, which can be temporarily compressed or indented by a golf ball. The members 104 and 108 shown in FIG. 1 may be metal cross bars which may be covered with tubes of fabric, such as fabric stiffer than the fabric used for front surface 121*a*. The top 120*a* of the impact device or panel 120, may be connected to a tube of fabric covering the member 104, while the bottom 120*b* of the impact device or panel 120, may be connected to a tube or fabric covering the member 108. The members 110, and 106 may be metal bars. The members 104, 106, 108, and 110 may be part of a metal frame.

The impact device 120 may also include a plurality of horizontal lines 124 which are numbered from the top 120*a* of the impact device 120 to the bottom 120*b* of the impact device as 35, 30, 25, 20, 15, 10, and 5, respectively. The numbers for the horizontal lines 124 represent an elevation level from the bottom 120*b* of the impact device 120. For example, 5, 10, 15, 20, 25, 30, and 35 may represent degrees of an angle B (or angle α in a formula which will be described), shown in FIG. 4, between a line L3, which is parallel to a ground surface 200, and a line L2. The line L2 has a first point at a marker, tee-off point or location 204 on a mat 202, and a second point on a center location 134. The horizontal line labeled 5 of the horizontal lines 124, may indicate an elevation angle of five degrees for angle B. The horizontal lines 124 and their numbers may be printed over the image or print 122 of the golf course. In theory, for angular representations, the horizontal lines 124 should be U shaped if the width of the panel 120 goes to infinity. Since the panel is relatively narrow, straight lines are used for simplicity.

The impact device 120 may also include a plurality of substantially vertical lines 126. The vertical lines may be labeled 12, 9, 6, 3, 0, 3, 6, 9, and 12, looking from left to right on the impact device 120. The numbers for the substantially vertical lines 126 may represent an angle or offset angle A between the line L2, or a vertical center plane, and a line L1, shown in FIG. 4. The line L1 has a first point at marker or location 204 and a second point at location 132. The vertical center plane is defined by the vertical center line 0 and the marker (tee-off point) 204. The offset angle A is shown as 9 degrees in FIG. 4. For example the vertical line 12 of the substantially vertical lines 126, may indicate an offset angle of twelve degrees from the vertical 0. Note that the line 126 is curved outwards. This is done because for the same offset angle, the higher on the panel or impact device 120, the line L2 is longer, and so is the offset distance Xoff in horizontal distance. The substantially vertical lines and their numbers may be printed over the image or print 122 of the golf course.

Figure 3:
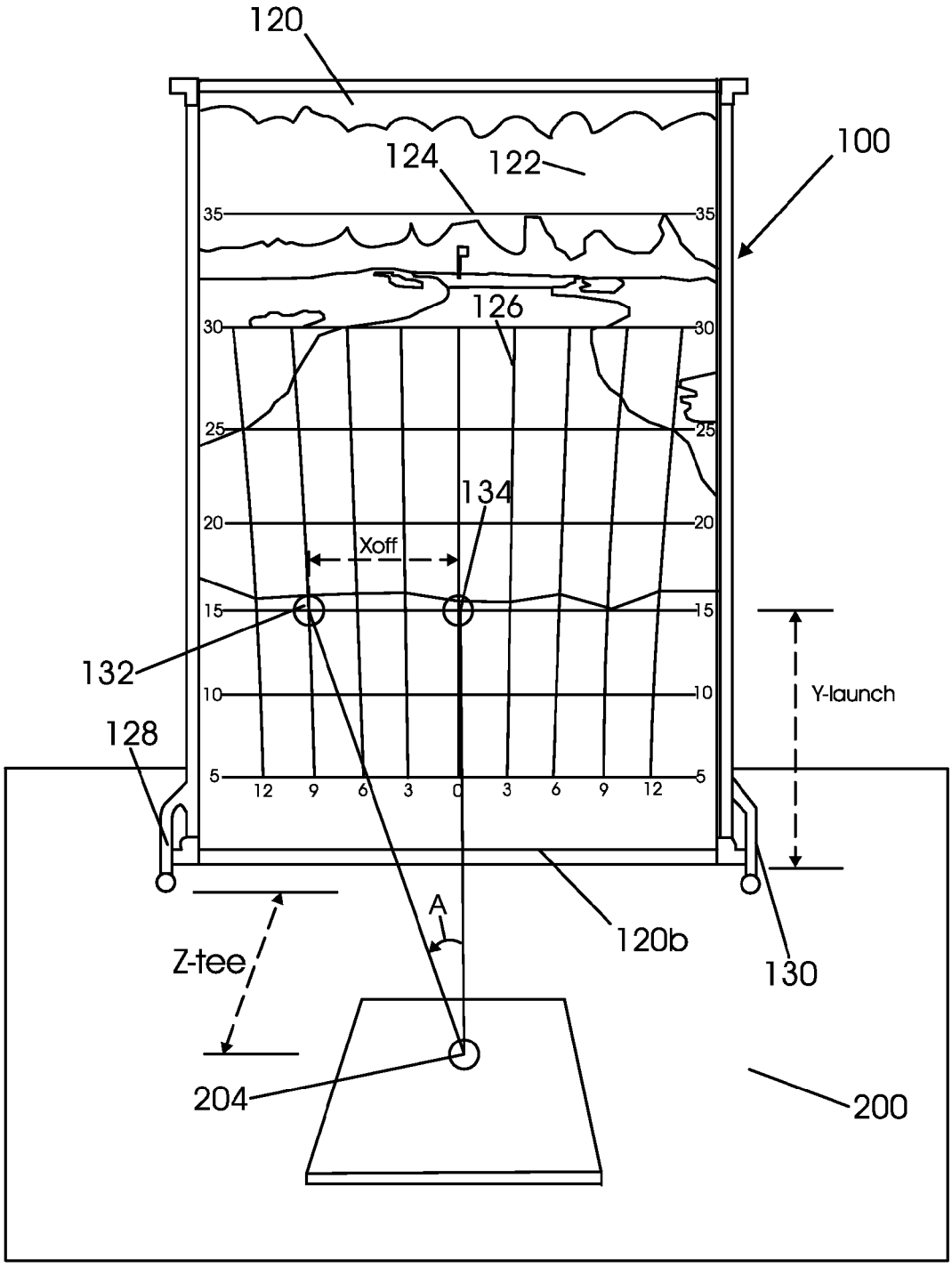
FIG. 3 shows a front view of the apparatus of FIG. 1 along with a perspective view of the mat of FIG. 2, and with diagram showing where a golf ball has impacted a portion of the apparatus of FIG. 1.

The following formula may be used to calculate the coordinates of the preset launch or elevation angle lines 124 as shown in FIG. 3.

$$y_{launch}=Z_{tee}\times\tan(\alpha\times\pi\div180)$$

Figure 4:
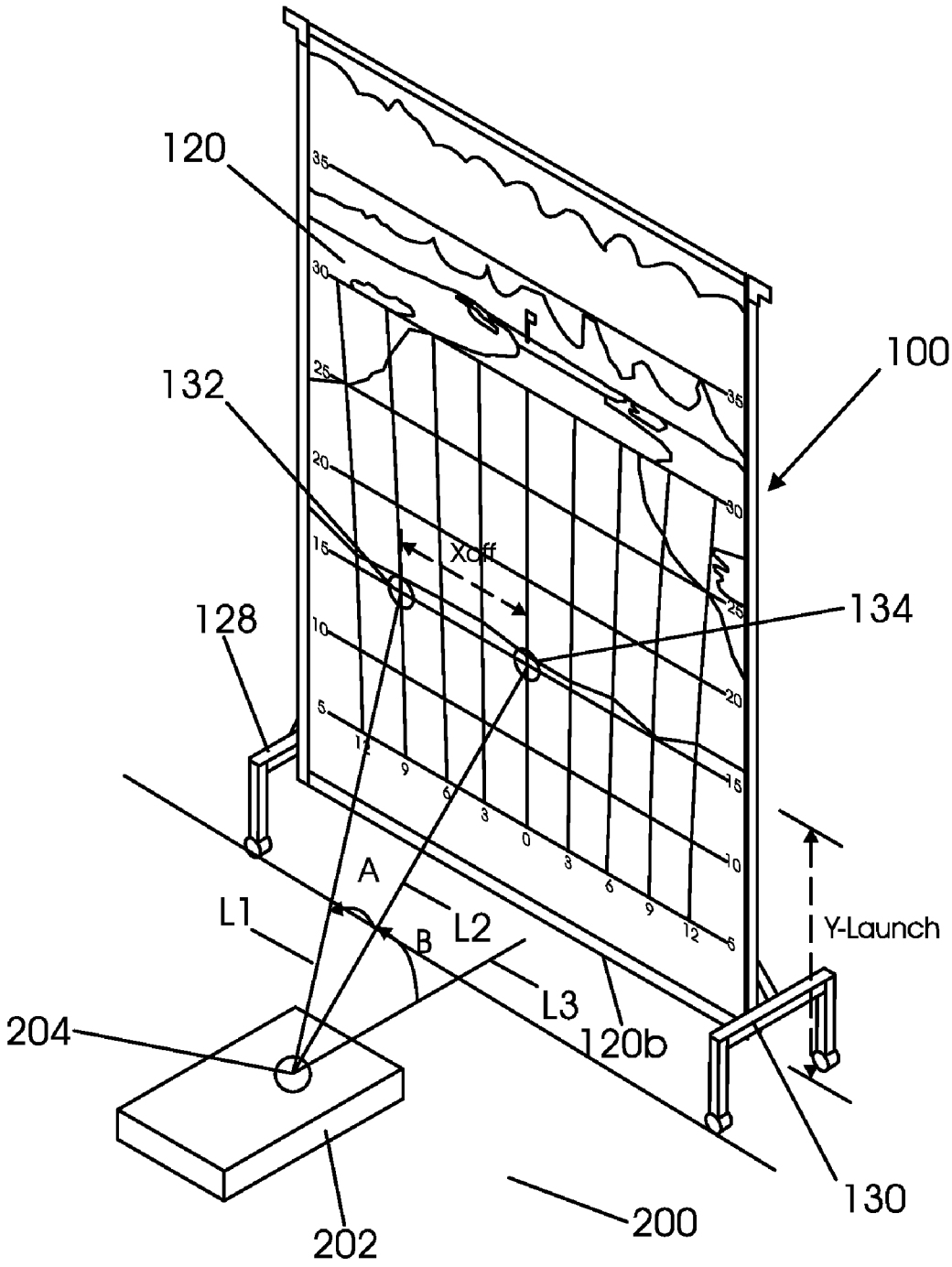
FIG. 4 shows a perspective view of the apparatus of FIG. 1 and the mat of FIG. 2.

Where, $y_{launch}$ is the y-axis coordinate of a preset launch or elevation angle;

α (angle B in FIG. 4) is the preset launch angle in degree of radius (angle B in FIG. 4);

$Z_{tee}$ is the preset distance between the tee-off point or marking 204, to the target panel or impact device 120.

Since the preset launch angle lines are horizontal, only the y-axis coordinates are needed.

The following formula is used to calculate the coordinates of the preset off-center angle lines:

$$x_{off}=\sqrt{y_{launch}^2+Z_{tee}^2}\times\tan(\beta\times\pi\div180)$$

Where, $x_{off}$ is the x-axis coordinate of a preset off-center angle

β is the preset off-center angle in degree of radius, (angle A in FIG. 4);

$y_{launch}$ is the y-axis coordinate of a preset launch angle;

$Z_{tee}$ is the preset distance between the tee-off point to the target panel.

Following table list the y-axis coordinates for the preset launch angle lines, and the x-axis coordinates of the crossing points of off-center angle lines at each launch or elevation angle line. The preset tee-off distance $Z_{tee}$ is 213.3 cm (seven feet).

| Launch Angle (°) | $y_{launch}$ (cm) | $x_{off}$(±3°) (cm) | $x_{off}$(±6°) (cm) | $x_{off}$(±9°) (cm) | $x_{off}$(±12°) (cm) |
|---|---|---|---|---|---|
| 35 | 149.35 | ±13.65 | ±27.37 | ±41.24 | ±55.35 |
| 30 | 123.15 | ±12.91 | ±25.89 | ±39.01 | ±52.35 |
| 25 | 99.46 | ±12.33 | ±24.74 | ±37.28 | ±50.03 |
| 20 | 77.63 | ±11.90 | ±23.86 | ±35.95 | ±48.25 |
| 15 | 57.15 | ±11.57 | ±23.21 | ±34.98 | ±46.94 |
| 10 | 37.61 | ±11.35 | ±22.76 | ±34.30 | ±46.04 |
| 5 | 18.66 | ±11.22 | ±22.50 | ±33.91 | ±45.51 |

The negative numbers on the chart above indicate numbers that are located on the left side of the 0 degree vertical center line on panel or impact device 120.

The preset launch or elevation angle lines 124 shown in FIG. 3, are drawn horizontally straight with the respective Y-launch. On each launch angle line of lines 124, the coordinate of ($x_{off}$, $y_{launch}$) is the crossing point of the prospective preset off-center angle line. Drawing a straight line between crossing points on the adjacent preset launch angle lines, presents a close match of the preset off-center angle line.

Figure 2:
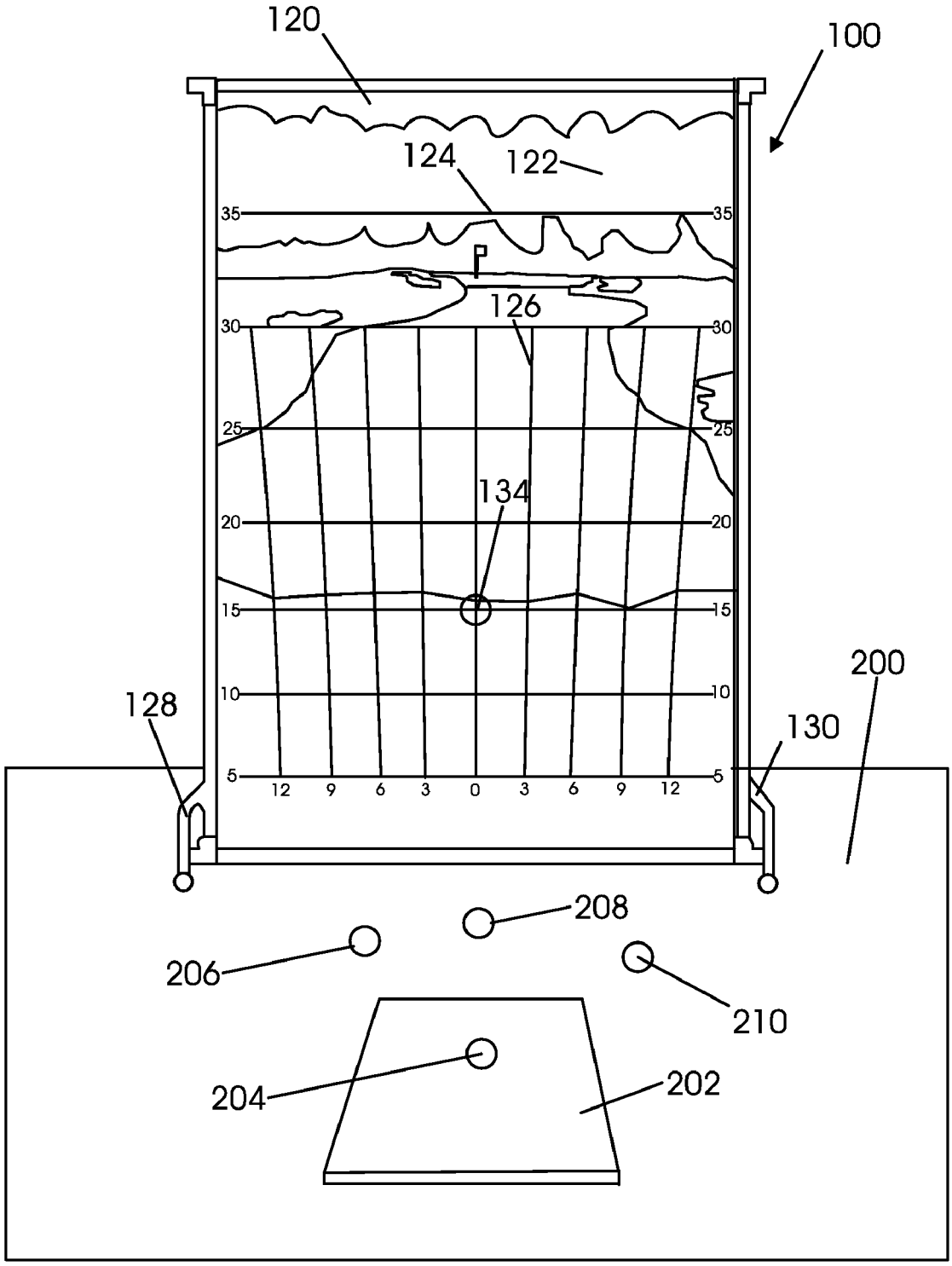
FIG. 2 shows a front view of the apparatus of FIG. 1 along with a perspective view of a mat and several golf balls.

FIG. 2 shows a front view of the apparatus 100 along with a perspective view of a mat 202 and golf balls 206, 208, and 210. The mat 202 includes a marking 204, where a golf ball can be placed. In accordance with an embodiment of the present invention, an individual can hit a golf ball from the mat 202, using a golf club, not shown, into the impact device 120. The mat 202 is typically placed with respect to the apparatus 100 so that the marking 204 is aligned with the center vertical line, labeled 0, of the substantially vertical lines 126. A golf ball, such as one of 206, 208, and 210, prior to hitting, is placed on top of the marking 204 on the mat 202. After the golf ball is hit it typically impacts a specific location of the impact device 120, such as aim location 134, and then rebounds back towards the mat 202, to the left (as shown for ball 206), to the right (as shown for ball 210), or straight back (as shown for ball 208). Due to the frictional property of the panel material, the direction of rebound of the golf ball indicates how the ball was spinning after it was hit. This indicates whether the ball was heading straight out, slicing or hooking when it was hit from the marking or tee off location 204. For a right handed golfer, after a ball hits the vertical center line 0 of lines 126 of 120, and a ball rebounding back to the direction of ball 206 would indicate left-to-right spin (a fade, or slice). A ball rebounding back to the direction of ball 210 would indicate right-to-left spin (a draw, or hook), and a ball rebounding back to the direction of ball 208 would indicate a backspin or straight shot (no substantial hook or slice). In general, the surface frictional property of any material may make a golf ball bouncing back more or less tilted in the opposite direction of its spin direction. In accordance with an embodiment of the present invention proper combination of the surface 121*a* material of the panel 120 and the kind of golf ball used will make tilted bouncing back profoundly detectable, such as a panel material for surface 121*a* made of 100% polyester super-micro throw and a non-standard golf ball made of soft polyurethane foam.

The target panel, or impact device 120, may be about six feet in height, from the top 120*a* to the bottom 120*b* and about four feet in width, from a connection to member 110 to a connection to member 106. Such a size for the target panel or impact device 120 will cover launch or elevation angles up to nearly forty degrees and lateral off-center deviation angles up to twelve radius degrees (on both left and right sides of the vertical center line 0 of vertical lines 126), when the tee-off point or marking 204, shown in FIG. 2, is seven feet in front the panel or impact device 120.

FIG. 3 shows a front view of the apparatus 100 of FIG. 1 along with a perspective view of the mat 200 of FIG. 2, and with a diagram showing where a golf ball has impacted the impact device 120. FIG. 3 shows a circle 132 representing a location where a golf ball has impacted the impact device 120 after being struck by a golf club from the marking 204 of the mat 202. FIG. 3 also shows a circle 134 which denotes the junction of the vertical center line 0 and the horizontal line 15. The golf ball, in this case, impacted the impact device 120 at location 132 at a distance of Xoff from the location 134 on the center vertical line. The impact location 132 is a distance Y-launch from the bottom 120*b*. The offset angle A for location 132, is nine degrees, and the elevation angle for location 132 is fifteen degrees (B in FIG. 4). The distance from where the golf ball was struck with a golf club, at marking or marker 204 to the bottom 120*b* may be called Z-tee and is typically preset at seven feet. The elevation angles and the offset angles which are shown on the impact device 120 are calculated for a preset Z-tee distance of seven feet.

FIG. 4 shows a perspective view of the apparatus 100 of FIG. 1 and the mat 200 of FIG. 2. The locations 132 and 134 are shown in FIG. 4. A straight line L1 is shown between the ball marking 204 (where the ball was hit) and the location 132 where the ball impacted the impact device 120. A straight line L2 is also shown between the marking 204 and the location 134 on the vertical center line 0. A straight line, L3, parallel to the ground 200, and perpendicular to both the bottom 120*b* of the impact device 120 and the vertical center line 0, is also shown. The line L1 makes an angle A with the line L2. The angle A, can be called an off center angle or offset angle The line L2 makes an angle B with the line L3. The angle B, can be called an elevation angle.

The target panel or impact device 120, for descriptive purposes may be said to rest in the x-y plane. The bottom 120*b* of the target panel or impact device 120 is the x-axis. The vertical center line 0 of the target panel 120 is the y-axis. The tee-off point or marker or marking 204 is on the z-axis, which is the line L3. The x-z plane can be seen as ground or floor 200. When a ball, such as a golf ball is hit from the tee-off point or marking 204 toward the impact device or target panel 120, the ball may hit and impact the target panel 120 at a location such as 132. When a golf ball impacts location 132, a ball mark will be made at the location 132. The launch or elevation angle B is the vertical angle between the ground (x-z plane) or line L3 and the ball traveling trace or line L2 shown in FIG. 4. The off-center angle A shown in FIG. 4, is the angle between the y-z plane and the ball traveling trace or line L2.

The golf balls, such as golf balls 206, 208, and 210 may be non standard golf balls which are made of soft polyurethane foam. The golf balls may be the same diameter as a standard golf ball but may weigh less compared to a standard golf ball. This kind of non-standard practice golf balls may fly in a similar pattern but for a much shorter distance compared to standard golf balls after having been struck by a club head of a golf club. Two types of non-standard golf balls which can be used are (a) "The Floppy" (trademarked) indoor practice golf ball, which is produced and marketed by "Up & Down, Inc" (trademarked) and described at www.thefloppy.com; and (b) practice golf balls made of a hard foam material, such as "Point3 almostgolf" golf balls marketed by Almostgolf (trademarked) at www.almostgolf.com. The practice golf balls called "almostgolf" golf balls are typically solid core, limited distance, internal pressure practice balls that give on-course performance in an off-course safe golf ball.

In accordance with an embodiment of the present invention, when a golf ball or practice golf ball, impacts the impact device 120 such as at location 132 shown in FIG. 4, the golf ball, after impacting and rebounding back towards the mat 202, leaves an impression, which can be seen by the golfer who hit the ball. The material for the impact device 120 is of a type which leaves at least a temporary impression upon impact with a golf ball or practice golf ball. A user can compare the location, such as 132, where the golf ball impacted with a center vertical line location, such as 134, to determine how far off center he or she has hit the ball. A user can also look at the elevation indicated by the horizontal lines and their number, to see if the ball was hit with the proper elevation. A chart, such as below, can be used to determine the proper elevation.

| Club | Loft Angle Range(Degs.) |
|---|---|
| Driver | 8-13 |
| 3 Wood | 12-17 |
| 5 Wood | 20-23 |
| 3 Iron | 21-24 |
| 4 Iron | 25-28 |
| 5 Iron | 28-32 |
| 6 Iron | 32-36 |
| 7 Iron | 36-40 |
| 8 Iron | 40-44 |
| 9 Iron | 45-48 |
| Pitching Wedge | 47-53 |
| Gap Wedge | 50-54 |
| Sand Wedge | 54-58 |
| Lob Wedge | 58-62 |

For example, if a golfer hit a golf ball into the impact location 132, the elevation is indicated as 15 degrees (corresponding to the horizontal line labeled 15). If the club used was a 3 wood, then as indicated by the chart above, the shot was an acceptable shot in terms of elevation because it's loft angle is within the ranges shown. For some other club, the shot might have been unacceptable. The elevation angle is typically determined by the loft of the club and the attacking angle of the swing. A golfer may practice different swing planes to achieve desired launch angles for specific club.

Figure 5:
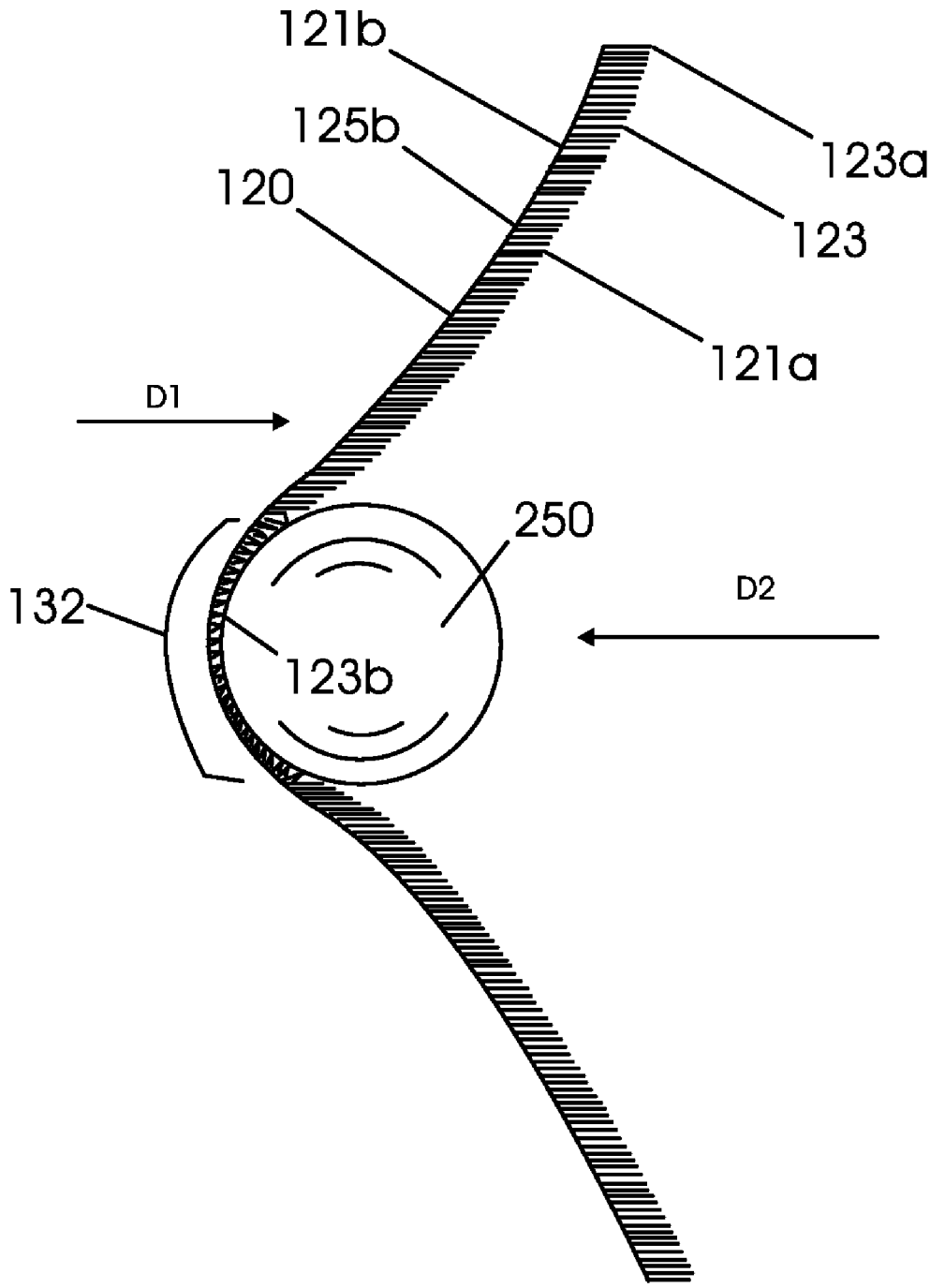
FIG. 5 shows a cross sectional view of a portion of the apparatus of FIG. 1, and a golf ball.

The target panel or impact device 120 may have a backing 121*b* as shown in FIG. 5. FIG. 5 shows a cross sectional view of a portion of the impact device or panel 120 after it has been impacted by a golf ball 250. The impact device 120 includes a plurality of strands, hairs, piles, or extensions, 123, which includes extension 123*a* and 123*b*. The extensions 123 extend straight out, such as shown for extension 123*a*, until impacted by an object, such as a golf ball. When the extensions 123 are impacted by a golf ball, they are bent and/or compressed. For example, FIG. 5 shows extension 123*b*, which has been compressed and/or bent. Extension 123*b* would be straight out, like extension 123*a* until the golf ball 250 impacts it and compresses extension 123*b* as shown in FIG. 5. An impression or visual indication is left in the area or location 132 where a plurality of the extensions have been compressed and/or bent, similar to extension 123*b*. The extensions in the area 132 remain compressed and/or bent, until they are put back in their extended state by, for example, using a hand to push the extensions back into their extended state.

In FIG. 5, the golf ball 250 travels in the direction D2 prior to impact with the surface 121*a* of the impact device 120. The golf ball 250 would travel in the direction D1 after the impact with the surface 121*a* of the impact device 120. The impression in the area or location 132 remains after the ball 250 rebounds back in the direction D1.

Figure 6:
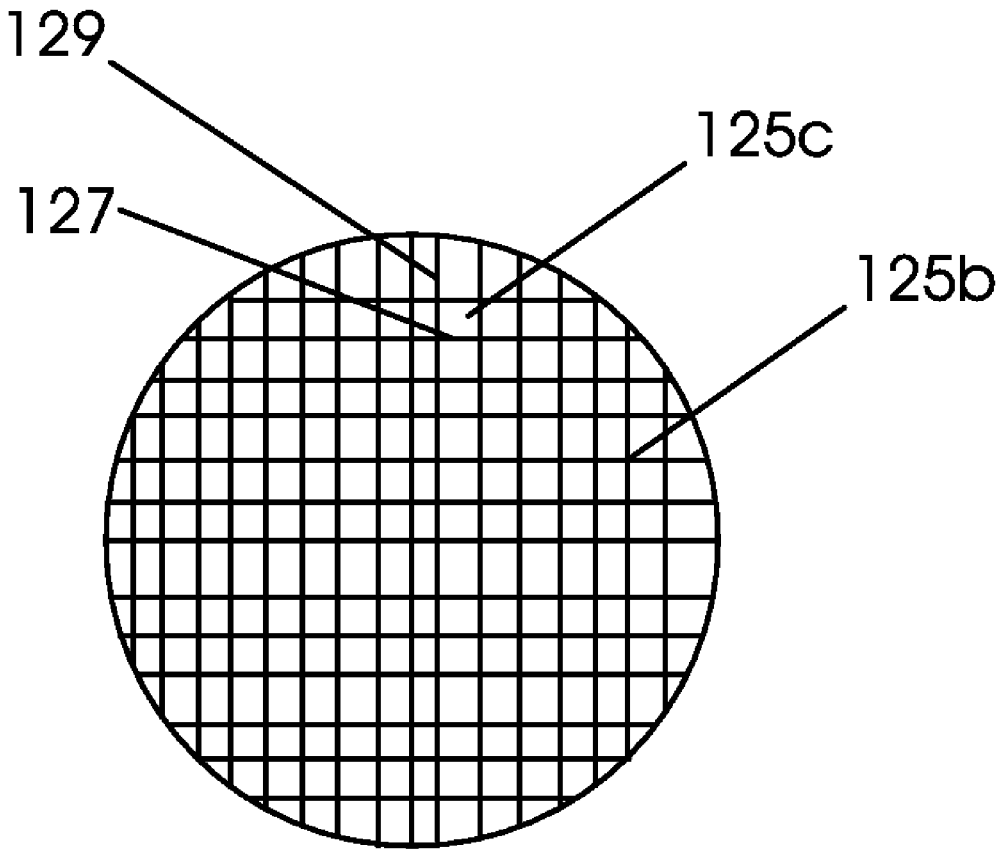
FIG. 6 shows a close-up front view of a portion of a backing for use with the apparatus of FIG. 1.

FIG. 6 shows a portion 125*b* of the backing 121*b*. The backing 121*b* may include vertical stitches or threads 129 and horizontal stitches or threads 127. The backing is loosely weaved so that there are spaces such as 125*c*, so that air can easily pass through the backing 121*b*. There is a space or gap between adjacent vertical threads of vertical threads 129 and there is a space or gap between adjacent horizontal threads of horizontal threads 127.

The backing 121*b* of the impact device 120 may be loosely weaved. The surface 121*a* of the impact device 120 may be a furry pile surface on the side where the golf ball 250 impacts or strikes. When the golf ball 250 impacts onto the surface 121*a* of the target panel or impact device 120, the golf ball 250 will press down on the plush surface 121*a* where the ball makes contact with the panel 120, such as at location 132 shown in FIG. 3. Meanwhile, the impact will force air travel in the direction D1, opposite to the direction D2 of the ball 250 direction, which will make the threads, strands, hair, or pile in areas other than location 132 to naturally extend outward, such as extension or hair 123*a*. Alternatively, or additionally, the extensions 123 may be naturally extending outward before the ball 250 hits. After the ball bounces off the panel 120, the pressed down pile (threads, hairs, or extensions, such as 123*b* in the are or location 132) shows a different texture at location 132 (i.e. is compressed as shown in FIG. 5) compared to the surrounding standing-up or extending outwards pile (hairs, strands, or extensions). That represents a visually identifiable ball mark of the strike on the target panel or impact device 120.

When another ball strikes onto the panel or impact device 120, the impact will create a new ball mark and totally or partially erase the previous ball marks in the approximate area. The ball marks can also be erased by simply touching the pile (or the hairs, strands, or extensions 123) on the panel or impact device 120 and making the pile or hair or extensions 123 of the have an even textured look. Since air can go through the panel or impact device 120 (because of the loosely weaved construction of panel or impact device 120), it will create a lesser popping sound compared to that from a target fabricated from a more tightly weaved material. Less noise is more desirable for a golfer practicing swing indoor. The impact device 120 can also be made of a memory foam.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for use as a target for a sports projectile comprising:

a panel; and a support structure for supporting the panel in an upright position;

wherein a substantially central vertical line is located on the panel so that it can be seen by a user;

wherein a plurality of spaced apart substantially vertical offset lines are located on the panel so that they can be seen by a user;

wherein each of the plurality of spaced apart substantially vertical offset lines is labeled to indicate an offset in relation, at least in part, to the substantially central vertical line;

wherein the panel includes a material of a type such that when a golf ball impacts a part of the material after the golf ball has been struck by a golf club, a visual indication of a change in texture is made on the part of the material of the panel indicating a location where the golf ball impacted the material;

wherein the visual indication of the change in texture on the part of the material remains on the panel after the golf ball is no longer in contact with the material and until removed by an external force which is not related to the resiliency of the material and which is not related to the resiliency of anything connected to the material when the golf ball impacted the part of the material;

wherein the material includes a first plurality of extensions;

wherein when the golf ball impacts the part of the material the golf ball impacts a second plurality of extensions, which is a subset of the first plurality of extensions, and causes the second plurality of extensions to become compressed; and wherein the second plurality of extensions remain compressed, after the golf ball has impacted the second plurality of extensions, after the golf ball is no longer in contact with the second plurality of extensions, and until an external force, which is not related to the resiliency of the material and which is not related to the resiliency of anything connected to the material when the golf ball impacted the part of the material, causes the second plurality of extensions to no longer be compressed.

2. The apparatus of claim 1 wherein each offset for each of the plurality of spaced apart substantially vertical offset lines is an angular offset;

wherein each angular offset is an angle made between a substantially central vertical plane and a second line for each of the plurality of spaced apart vertical offset lines;

wherein the substantially central vertical plane includes the substantially central vertical line and a marker in front of and a distance away from the panel;

wherein each second line is a line from the marker to each of the plurality of spaced apart substantially vertical offset lines.

3. The apparatus of claim 2 wherein each of the plurality of spaced apart substantially vertical offset lines is labeled with a number to indicate a number of degrees.

4. The apparatus of claim 1 wherein the material has a plurality of spaces so that air can pass through the material;

wherein the material has a front side and an opposing rear side;

wherein the apparatus is configured so that when the golf ball impacts the part of the material, the golf ball impacts the front side of the material, and air flows in a first direction from the rear side of the material into the plurality of spaces of the material, through the plurality of spaces of the material, and out the front side of the material and the air flowing in the first direction causes a third plurality of extensions to straighten; and wherein the third plurality of extensions is a subset of the first plurality of extensions, but does not include the second plurality of extensions.

5. The apparatus of claim 2 further comprising a golf mat;

and wherein the marker is a visual indication located on the golf mat.

6. The apparatus of 1 wherein an image of a golf course scene is located on the panel and the substantially central vertical line and the plurality of spaced apart substantially vertical offset lines are located on the golf course scene.

7. The apparatus of claim 1 wherein a plurality of spaced apart substantially horizontal elevation lines are located on the panel so that they can be seen by a user; and wherein each of the plurality of spaced apart substantially horizontal elevation lines is labeled to indicate an elevation in relation to a base elevation.

8. The apparatus of claim 7 wherein each elevation for each of the plurality of spaced apart substantially horizontal elevation lines is an angular elevation;

wherein each angular elevation is an angle made between a base plane and a second line for each of the plurality of spaced apart horizontal elevation lines; and wherein each second line is a line from the marker to each of the plurality of spaced apart substantially horizontal elevation lines.

9. The apparatus of claim 8 wherein each of the plurality of spaced apart substantially horizontal elevation lines is labeled with a number to indicate a number of degrees.

10. An apparatus for use as a target for a sports projectile comprising:

a panel; and a support structure for supporting the panel in an upright position;

wherein a substantially central vertical line is located on the panel so that it can be seen by a user;

wherein a plurality of spaced apart substantially vertical offset lines are located on the panel so that they can be seen by a user;

wherein each of the plurality of spaced apart substantially vertical offset lines is labeled to indicate an offset in relation, at least in part, to the substantially central vertical line;

wherein the panel includes a material of a type such that when a golf ball impacts a part of the material after the golf ball has been struck by a golf club, a visual indication of a change in texture is made on the part of the material of the panel indicating a location where the golf ball impacted the material;

wherein the visual indication of the change in texture on the part of the material remains on the panel after the golf ball is no longer in contact with the material and until removed by an external force which is not related to the resiliency of the material and which is not related to the resiliency of anything connected to the material when the golf ball impacted the part of the material; and wherein the material is one hundred percent polyester.

11. An apparatus for use as a target for a sports projectile comprising:

a panel; and a support structure for supporting the panel in an upright position;

wherein a substantially central vertical line is located on the panel so that it can be seen by a user;

wherein a plurality of spaced apart substantially vertical offset lines are located on the panel so that they can be seen by a user;

wherein each of the plurality of spaced apart substantially vertical offset lines is labeled to indicate an offset in relation, at least in part, to the substantially central vertical line;

wherein the panel includes a material of a type such that when a golf ball impacts a part of the material after the golf ball has been struck by a golf club, a visual indication of a change in texture is made on the part of the material of the panel indicating a location where the golf ball impacted the material;

wherein the visual indication of the change in texture on the part of the material remains on the panel after the golf ball is no longer in contact with the material and until removed by an external force which is not related to the resiliency of the material and which is not related to the resiliency of anything connected to the material when the golf ball impacted the part of the material; further comprising the golf ball;

wherein the golf ball and the material are configured so that the golf ball does not adhere to the material; and wherein the golf ball and the material are configured so that the golf ball, after impacting with the part of the material, rebounds off of the part of the material in a first direction which is opposite a second direction, wherein the second direction is a direction in which the golf ball was spinning when the golf ball impacted with the part of the material.

* * * * *